United States Patent [19]

Wirtgen

[11] Patent Number: 4,462,690

[45] Date of Patent: Jul. 31, 1984

[54] APPARATUS FOR THE PRODUCTION OF APPLICABLE COATING MATERIAL FOR COATING MILLED-OFF OR PEELED-OFF ROAD SURFACES

[76] Inventor: Reinhard Wirtgen, Hohner Strasse 2, D-5461 Windhagen/Linz, Fed. Rep. of Germany

[21] Appl. No.: 341,505

[22] Filed: Jan. 21, 1982

[30] Foreign Application Priority Data

Feb. 20, 1981 [DE] Fed. Rep. of Germany ..... 3106347

[51] Int. Cl.[3] ..... B28C 5/42; B28C 5/46

[52] U.S. Cl. ..... 366/25; 366/40; 366/44; 366/57; 432/72; 432/105

[58] Field of Search ..... 366/10, 11, 12, 22–25, 366/27, 40, 42, 44, 53, 54, 57, 59, 144, 147, 187, 188, 189, 219–221, 223, 225–229, 606; 432/72, 73, 105, 106, 110, 111

[56] References Cited

U.S. PATENT DOCUMENTS

| | | | |
|---|---|---|---|
| 1,777,002 | 9/1930 | Knowles . | |
| 2,029,126 | 1/1936 | Rybeck | 366/44 |
| 2,421,345 | 5/1947 | McConnaughay | 366/25 |
| 2,487,887 | 11/1949 | McEachran . | |
| 2,781,186 | 2/1957 | Harbers et al. | 366/44 |
| 4,208,131 | 6/1980 | Mendenhall | 366/25 X |

FOREIGN PATENT DOCUMENTS

| | | |
|---|---|---|
| 13946 | 8/1980 | European Pat. Off. . |
| 17499 | 10/1980 | European Pat. Off. . |
| 838451 | 5/1952 | Fed. Rep. of Germany . |
| 1891454 | 4/1964 | Fed. Rep. of Germany . |
| 1784084 | 7/1971 | Fed. Rep. of Germany . |
| 2340599 | 2/1975 | Fed. Rep. of Germany . |
| 2456143 | 1/1976 | Fed. Rep. of Germany . |
| 7707334 | 7/1977 | Fed. Rep. of Germany . |
| 2846506 | 8/1980 | Fed. Rep. of Germany . |

*Primary Examiner*—Timothy F. Simone
*Attorney, Agent, or Firm*—Steinberg & Raskin

[57] ABSTRACT

The invention relates to a process and an apparatus for the production of applicable coating material for coating road surfaces, by which the old coating material together with aggregates and/or new coating material is mixed in a mixer device provided on a vehicle and is heated in an indirect manner. The apparatus comprises a mixer drum arranged on a vehicle rotatable along its longitudinal axis and including a heating device extending along a substantial portion of the drum length as well as guide fins provided at the interior circumference thereof rotating in a first direction of rotation the material in the mixer drum and in a second direction of rotation conveying the mixed material out of the mixer drum.

7 Claims, 2 Drawing Figures

APPARATUS FOR THE PRODUCTION OF APPLICABLE COATING MATERIAL FOR COATING MILLED-OFF OR PEELED-OFF ROAD SURFACES

BACKGROUND OF THE INVENTION

The invention relates to a process for the production of applicable coating material for coating milled-off or peeled-off road surfaces, by which either new coating material or the milled-off or peeled-off coating material is mixed with aggregates and/or new coating material in a mixer provided on a vehicle. The invention relates furthermore to an apparatus for performing this process.

The production of applicable coating material for coating road surfaces of new coating material or by treating milled-off or peeled-off road coating material in order to use it anew is, in general, so performed that the new coating material is brought to the site from a mixer plant or, when treating the old road coating material, the latter is brought by trucks to a treatment plant, is mixed with new coating material or aggregates and is directly heated by means of gas flames directed onto the mixture. The material so treated and heated is subsequently transported by trucks to the road portion(s) milled-off or peeled-off where it is made into the new road surface.

Considering that in the course of the heating of the coating material mixture, dust and dirt is whirled up by the gas flames directed onto the material and moreover offensively smelling gases and vapors are formed by local overheating, the treatment of milled-off or peeled-off road coating material is allowed in officially authorized industrial zones only. The distance to be covered by the trucks for bringing and getting the coating material are therefore rather considerable so that transportation costs constitute a substantial amount in the repair of roads in a certain distance from a treatment plant. In case of larger repair works, a substantial truck traffic will be necessary, which particularly in case of repair works in residential areas will attract negative attention by the residents. Prior to each repair work, finally, particular material flow dispositions have to be taken into consideration to make sure that a continuous provision of the road construction site with new or treated coating material is assured.

SUMMARY OF THE INVENTION

These disadvantages are to be abolished by the present invention. It is therefore the aim of the invention to provide a process for the production of applicable coating material of new coating material or by treating milled-off or peeled-off road coating material, which process may be performed in the immediate neighborhood of the construction site and which, when treating old road coating material will also provide coating material the properties of which, such as abrasive resistance, weather resistivity and workability are as good as in case of exclusively new coating material.

Starting from the prior art process, this problem is solved in that the mixture of the coating material is heated in an indirect manner during the course of the mixing.

In the process according to the invention, the material is not directly heated as is the case in the prior art process but is rather heated in an indirect way. During indirect heating of the coating material, as experiments have shown, neither offensive gases occur during the heating, because overheatings are excluded by indirect heating, nor can dust and dirt be whirled up, because the heating medium does not act under pressure onto the material to be heated. This opens the possibility to perform the process of the invention also in areas where the prior art process cannot be practised because of restrictions issued by the authorities. In other words, the process according to the invention makes the treatment of the coating material directly on the working site possible. An extensive and expensive truck traffic between treatment plant and working site is no longer necessary because when carrying out the process at the working site, only the new coating material or the aggregates or the coating material newly added has to be brought to the site.

It has been shown to be particularly advantageous if in the production of the new coating material, the mixing and the heating of the coating material is performed during travelling.

In accordance with an advantageous embodiment of the process, the mixture of the coating material is heated to about 180° C. It has been shown that in case of heating to a higher temperature, the heating period becomes too long and in the course of such a heating, the first signs of gas generation in the material are observed. The temperature of about 180° C. constitutes therefore the optimum temperature for the coating material to be applied.

As the heating process takes a longer period of time as compared to the prior art process, it is advisable to use a combustible gas for heating in view of the lower costs as compared to heating oil, which could be used as well and of the lower molestation of the environment.

In accordance with a further idea of the invention, the invention relates to an apparatus for performing the process described above. The apparatus differs from the prior art in that, in accordance with the invention, in order to receive the coating material(s) and/or aggregates, a mixer drum arranged on a vehicle, rotatable around its longitudinal axis and in operational connection to a drive motor is provided, which mixer drum includes a heating device extending along a substantial portion of the drum length as well as guide fins provided at least at the interior circumference thereof rotating, in a first direction of rotation of the mixer drum, the material in the drum to be mixed, and, in a second direction of rotation, conveying the mixed material in the drum out of the mixer drum.

After filling the mixer drum with the material to be mixed with one another, which may be performed via a charger funnel, the drive motor for the mixer drum is set in operation and the mixer drum rotates accordingly around its longitudinal axis. Together with the rotation of the mixer drum, the heating device starts working and indirectly heats the material intimately being mixed through the rotation of the mixer drum. In view of the guide fins arranged in the interior of the mixer drum, the material is subjected to a constant movement along the longitudinal axis of the drum on one hand and to a rotational movement on the other, such movement adding substantially to the intimate mixing of the material. The mixing process is performed by rotating the mixer drum into a predetermined direction of rotation. As soon as heating of the material within the drum is sufficient, the mixer drum is driven into a direction of rotation contrary to the prior direction so that with each rotation the material may emerge from the mixer drum.

In accordance with an advantageous embodiment of the invention, the heating device of the apparatus comprises a combustion tube secured to one front wall of the mixer drum, which combustion tube includes at least one burner and supports itself via radial supports on the interior periphery of the mixer drum. By means of such a heating device, a particularly good and material protecting heating and mixing of the material in the mixer drum may be obtained. The combustion tube is made from a material, which withstands high heat loads and has moreover a good thermal conductivity so that as little heat losses as possible are experienced in the heating system.

In order to transfer the heat energy emitted from the combustion tube as extensively as possible and without any losses onto the material to be mixed, it is advisable to produce each radial support from a large-area sheet metal, which is in good thermal contact to the combustion tube. In this way, not only a good heat radiation from the combustion tube to the material to be mixed is obtained but there is also a direct heat transfer from the sheet metal onto the material brought into contact with it.

In a particularly advantageous embodiment of the invention, each of the radial supports consists of a tube portion the interior space of which is connected, via an opening in the combustion tube, to the interior space of the combustion tube. In this embodiment, the individual radial supports are heated from inside, which leads to a still more uniform heating of the mixer drum interior and thus of the material in it and moreover to a still better heat transfer between the combustion tube and the material to be heated. The individual supports, which resemble tube portions may have different cross sectional shapes. According to an advantageous embodiment, each tube portion is of oval cross section. Such a cross sectional shape has the advantage that the material in the mixer drum is paticularly well mixed by the whirl produced behind the tube portion and on the other hand the material will glide along the surface of the tube portion for a longer period of time and can draw heat during this period. Instead of an oval cross section, each tube portion may also be of rhombic cross section. By means of such a cross section, mixing of, and heat transfer to, the material in the mixer drum may be improved. It is suitable if the long cross sectional axis of this tube portion of either a rhombic or oval cross section is essentially at right angles relative to the longitudinal axis of the mixer drum. Although an arrangement is possible, where the short cross sectional axis is at right angles relative to the longitudinal axis of the mixer drum, less favorable heat transfer conditions are experienced in such an arrangement and that is why such an arrangement will be employed only in special cases, where a particularly strong mixing of the individual material, and less a particularly good heating, is required.

A compromise between these two arrangements of the tube portions, an arrangement of the long cross sectional axis at right angles relative to the longitudinal axis of the mixer drum on one hand and short cross sectional axis at right angles relative to the longitudinal axis of the mixer drum on the other, constitutes an embodiment, wherein each tube portion is helically shaped around its longitudinal axis. By means of such tube portions optimum mixing and heating results are obtained; such tube portions, on the other hand, are particularly expensive in production so that they are employed in special cases only.

A further improvement of the mixing and uniform heating of the individual material in the mixer drum may, in accordance with a further idea of the invention, be obtained in that the radial supports are arranged in a fin-shaped formation in the interior of the mixer drum thus substituting the guide fins. As in such a case the additional provision of guide sheet metals may be left out, this constitutes an embodiment creating particularly low production costs.

In accordance with a further idea of the invention, at least one of the tube portions connects the interior space of the combustion tube via an aperture in the mantle of the mixer drum to the ambient air, in other words at least one of the tube portions is used as a duct for the exhaust gases collected in the combustion tube. In an advantageous further development of this embodiment, each interior space of each tube portion is assigned an aperture in the mantle of the mixer drum, where the individual apertures provided in a cross sectional level of the mixer drum discharge into an annular channel provided on the outer periphery of the drum, which on their side are connected to an exhaust gas tube. In this embodiment, the exhaust gases produced in the combustion tube are guided through the individual tube portions to the outer periphery of the mixer drum and therefrom, via individual channels, to an exhaust tube. In such an embodiment, the heat of the exhaust gases is used for the additional heating of the interior space of the mixer drum, which has a particularly energy saving effect on the apparatus.

A further rather substantial reduction of the operational costs of the apparatus may be obtained in that at least in part of the tube portions serving as exhaust gas channels, at a location distant from the combustion tube, exhaust gas valves are provided varying the aperture cross section. By correspondingly varying the effective aperture cross section of the tube portions, it may be reached that the exhaust gases escape with a reduced flow velocity from the combustion tube and thus may radiate more heat energy to the interior space of the mixer drum than would be the case with normal exhaust velocity. The individual gas valves may be manually adjustable. Considering however that in case of incorrect handling incomplete combustion of the heating material in the combustion tube may be experienced, which is particularly the case if and when during the course of full burner operation the exhaust valves are completely closed or are in an area corresponding to such a position, each exhaust gas valve is operable, in accordance with a further development of this embodiment, by means of a bimetal provided within the tube portion such that with iincreasing temperature within the tube portion the exhaust valve is moved into an open position and with decreasing temperature is moved into a closed position.

In accordance with an advantageous embodiment of the invention, a burner is provided secured to the mixer drum front wall carrying the combustion tube. Such an embodiment is particularly of advantage in case of smaller apparatuses having a not-too long mixer drum. In case of greater apparatusses, an embodiment is advisable, wherein a plurality of burners arranged one after the other in the combustion tube is provided.

The burner, or the burners, respectively, may either be provided as gas burner(s) or as oil burner(s). With a view to the greater weight and the higher costs of the oil to be used in an oil burner and with a view to the soot produced and the molestation by the odor, the employment of a gas burner and thus the use of gas is however preferred. In certain cases, the employment of an oil burner may however be of advantage as well.

A further decrease of the operational costs of the apparatus may be reached in that the mixer drum is provided on its outside with a heat insulation. Such heat insulation may for instance consist of an asbestos stratum of medium thickness.

The arrangement of the heating device within the mixer drum may freely be selected. In accordance with one embodiment, the heating device may concentrically be provided within the mixer drum and in accordance with another embodiment may excentrically be provided. The excentrical arrangement of the heating device in the mixer drum has the advantage that the material to be heated at the beginning of the mixing and heating process may be heated to a relatively high starting value, which is obtained in that the mixer drum is rotated into a position in which the heating device is on its lowest level and hence the material to be heated is located around the heating device. The disadvantage is that in view of the eccentricity of the heating apparatus, an unfavorable power distribution in the mixer drum is experienced causing the bearings, in which the mixer drum is supported, to require a particular shape. A particular drive has additionally to be provided, which will stand the different loads. These disadvantages are avoided in the case of a concentric arrangement of the heating device.

Which of the two embodiments will finally be employed depends on which priorities the user will attribute to the advantages and disadvantages of the two heating device arrangements.

By arranging the mixer drum on a chassis having its own drive engine, it becomes possible to use the apparatus not only in connection with a machine for peeling or milling road surfaces, but also as a shuttle on several working sites at one time while the material may be mixed and heated during the course of the transport. Particularly in case of this embodiment it is recommendable to arrange the mixer drum in inclined relation relative to the longitudinal axis of the chassis, the end of the mixer drum assigned to the burner being higher than the other drum end. By the inclined arrangement of the mixer drum on the chassis, more favorable storing possibilities as well as improved travelling properties of the automotive apparatus are achieved as compared to an arrangement of the mixer drum in parallel relation. The arrangement of the burner on the higher end of the mixer drum constitutes moreover a safety measure, which is of particular significance in case of an apparatus taking part in public road traffic.

In order to drive the mixer drum, it is most suitable to provide the mixer drum at the outer periphery thereof with a gear rim meshing with a tooth wheel driven by a drive motor. The shaft of the drive motor may directly, or via a drive chain, be connected to the tooth wheel meshing with the gear rim. Instead of a gear rim provided on the outer periphery, a tooth wheel may be arranged on the shaft end provided on the mixer drum and engaging with a tooth wheel in operating connection with the drive motor. In case of this embodiment however, a motor having a greater torque is necessary.

On the vehicle carrying the heatable mixer drum, there is provided, in accordance with a further advantageous embodiment of the present invention, a container which may, if necessary, also be heatable, for liquid bitumen, from which the latter, if needed may be added to the coating material.

By employing such an embodiment, it is possible to add not only if and when it is necessary to the coating material further bitumen in order to improve the material quality; new coating material of mineralic substances and the bitumen may at any location and independent from a special mixing plant be produced as well.

BRIEF DESCRIPTION OF THE DRAWINGS

The invention will now be explained in detail based on the drawing, which partly in a schematic representation depicts an exemplified embodiment.

FIG. 3 is a view similar to FIG. 2 illustrating an embodiment of the invention wherein the radial supports of the burner have a fin-shaped construction.

DETAILED DESCRIPTION OF A PREFERRED EMBODIMENT

Figure 1:
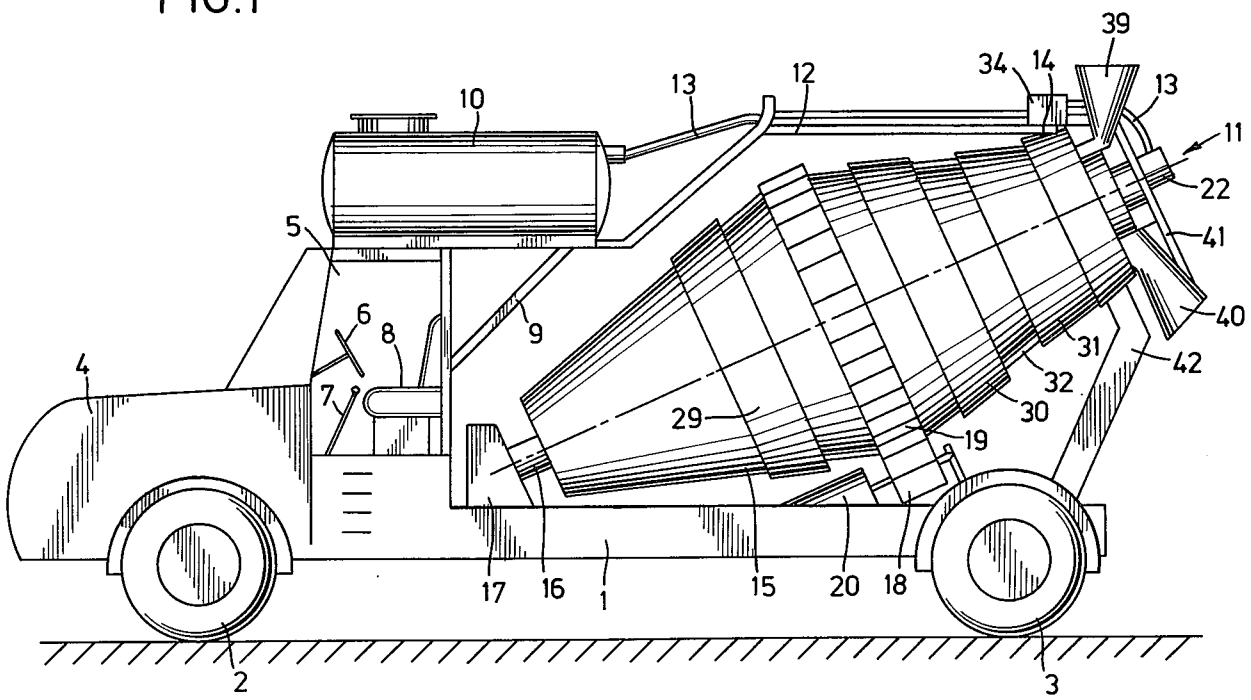
FIG. 1 is a lateral view of the whole apparatus.

The apparatus for the production of applicable coating material for coating milled-off or peeled-off road surfaces by treating milled-off or peeled-off road coating material comprises a chassis 1 including a steerable front wheel pair 2 and a driven rear wheel pair 3. In the front portion of chassis 1, under a bonnet 4, there is the drive engine for the apparatus and the driver's cabin 5 including a steering wheel 6 and further operating means 7 as well as a seat 8. On the roof of driver's cabin 5 and on a carrier frame 9, a liquid gas container 10 is provided, which contains the liquid gas for heating device 11 of the apparatus. A container, which may also be heatable, for the liquid bitumen may be provided as well. To the carrier frame 9 furthermore a holding structure 12 for the gas pipes 13 running from container 10 to the heating device 11, is secured. The holding structure 12 is supported by means of a fork 14 on heating device 11.

Behind driver's cabin 5, the mixer drum 15 of the apparatus is provided. The mixer drum 15 carries, at one end, a shaft end 16, by which it is supported on a bearing 17 provided on chassis 1. Further support of mixer drum 15 is brought about by means of two tooth wheels arranged side by side, of which only tooth wheel 18 is visible. Tooth wheel 18 as well as the other, not visible, tooth wheel mesh with a gear rim 19 provided on the outer periphery of the mixer drum. Tooth wheel 18 of the two tooth wheels is connected to a drive motor 20, by which mixer drum 15 may be driven, depending on the direction of rotation of the motor 20, to the left or to the right.

Figure 2:
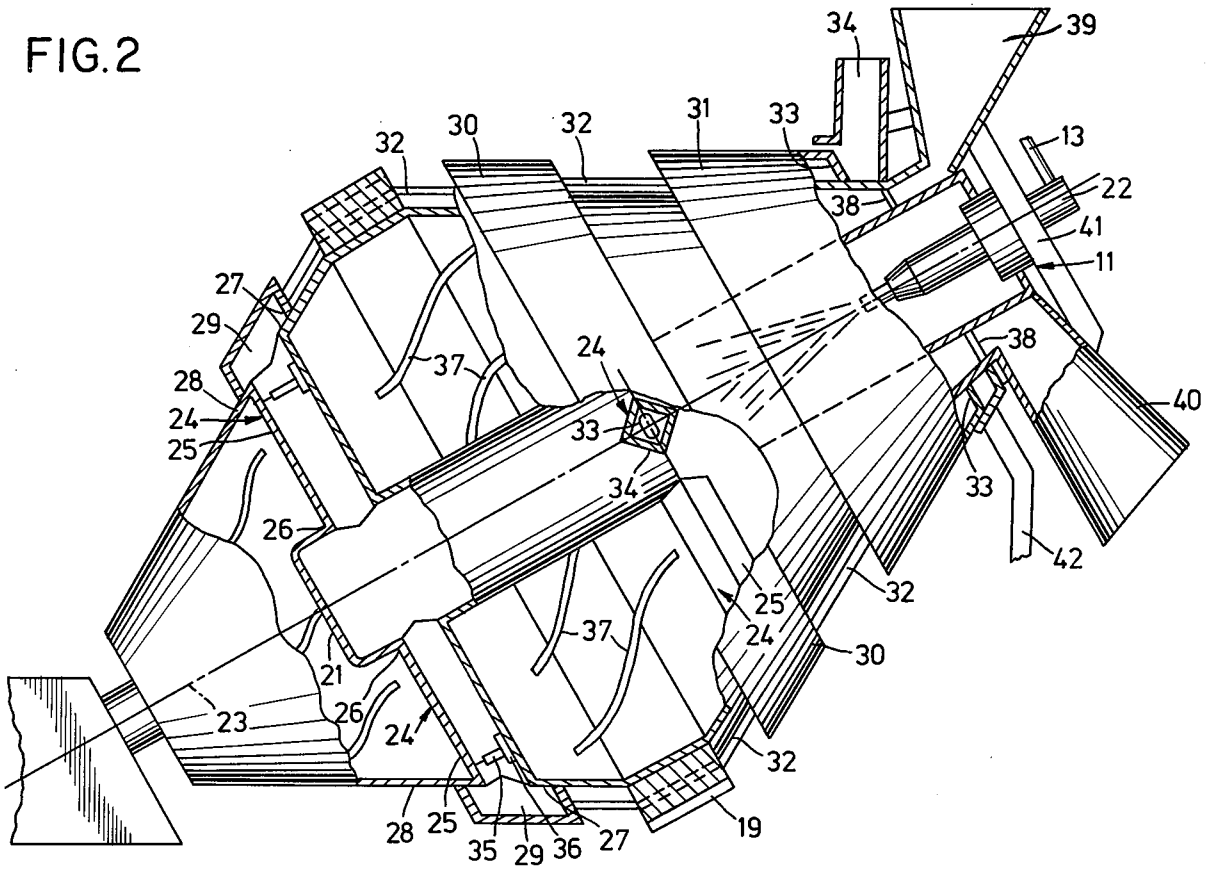
FIG. 2 is a lateral and, in parts, sectional view of the mixer drum of the apparatus according to FIG. 1.

The heating device 11, which is provided on the front side of mixer drum 15, opposite shaft end 16, comprises, as may particularly be taken from FIG. 2, a combustion tube 21 closed at the end extending into the mixer drum interior, and at its other end is shaped to receive a burner 22. Burner 22 is stationarily secured so that, when the mixer drum rotates, the burner 22 retains its position relative to the holding structure 12.

The combustion tube is concentrically arranged relative to the longitudinal axis 23 of mixer drum 15 and supports itself via a plurality of radial supports 24 on the outer wall of mixer drum 15.

Each of these radial supports 24 is shaped as a tube portion 25 of rhombic cross section. The interior space of each tube portion 25 is connected on one hand, via an opening 26 in the combustion tube 21 and on the other hand, via an aperture 27 in the wall 28 of mixer drum 15, to an annular channel 29, or 30, or 31, respectively. Annular channels 29, 30 and 31 are connected, via a number of tubular ducts 32, which are partly guided through corresponding recesses in gear rim 19. Annular channel 31 includes, at its front side, a number outwardly directed openings 33, through which the exhaust gases may escape into an exhaust tube 34, which is stationarily provided relative to the annular channel and comprises a ring receiving the exhaust gases and a funnel.

In each of the tube portions 25, exhaust valves 35 are provided in the area of wall 28 of mixer drum 15 which, by means of a spirally bent bimetal element 36, vary the opening cross section of the tube portion depending on the temperature such that with increasing temperature in the tube portion the exhaust valve is more and more opened while with decreasing temperature is more and more closed.

For an intimate mixing and uniform heating of the material in the mixer drum, guide fins 37 are additionally provided in mixer drum 15, which are so shaped that the material in the mixer drum is well mixed in one direction of rotation of the mixer drum 15 and this material is discharged from the mixer drum 15 in the other direction of rotation of mixer drum 15.

Charging and discharging of mixer drum 15 is brought about by a number of openings 38 provided at the front side of mixer drum 15, where also the burners are provided. These openings 38 co-operate together with a feeding hopper 39 and a chute 40. Feeding hopper 39, chute 40 and exhaust gas tube 34 are secured to a carrier 41 and constitute a stationary unit, which is supported by a fork-shaped holder 42 on chassis 1.

When charging the mixer drum 15, the material is fed into feeding hopper 39 from where it reaches, through openings 38 passing the feeding hopper, the interior of the drum. When discharging from the mixer drum 15, the material is transported through openings 38 from drum 15 into chute 40.

Referring to FIG. 3, another embodiment of the invention as illustrated which is substantially similar to that of FIGS. 1 and 2 and, accordingly, corresponding elements have been designated with identical reference characters. However, in the embodiment of FIG. 3, the guide fins of the embodiments of FIGS. 1 and 2 have been replaced with radial supports, designated 24', having a fin-shaped construction. Such a construction provides for lower production costs in that the mixing and uniform heating of the material in the mixing drum is improved.

Obviously, numerous modifications and variations of the present invention are possible in the light of the above teachings. It is therefore to be understood that within the scope of the claims appended hereto, the invention may be practiced otherwise than as specifically disclosed herein.

I claim:

1. In an apparatus for producing material for coating road surfaces, including mobile support means, a mixer drum having an inner surface defining a mixing space communicating with material inlet and outlet means, said mixer drum mounted on said support means and adapted to rotate about a longitudinal axis thereof, means for rotating said mixer drum about its longitudinal axis, means disposed on an inner surface of said mixer drum for mixing the material when said mixer drum rotates in one direction, and for conveying the material to facilitate the discharge of the material from said mixer drum when said mixer drum rotates in an opposite direction, and means situated within said mixer drum for heating the material charged into said mixer drum through said inlet means, said heating means including combustion means, the improvement comprising:

said combustion means including a combustion tube mounted so as to enter into the mixing space of said mixer drum, and at least one elongate support having one end connected to said combustion tube and extending substantially radially therefrom, the other end of said elongate support being connected to the inner surface of said mixer drum, said elongate support constituted of thermally-conductive material, whereby the material charged into the mixing spaces passes over said at least one support, to be heated by said at least one support.

2. An apparatus according to claim 1 which comprises a plurality of said radial supports, wherein each of said radial supports comprises a tube portion, the interior space of which is connected, via an opening in said combustion tube, with the interior space of said combustion tube.

3. An apparatus according to claim 1 which comprises a plurality of said radial supports, wherein said radial supports are arranged in a fin-shaped formation in the interior of said mixer drum.

4. An apparatus according to claim 2, wherein at least one of said tube portions connects the interior space of said combustion tube via an aperture in said mixer drum, with the ambient atmosphere.

5. An apparatus according to claim 4, wherein each interior space of each tube portion communicates with a respective aperture in said mixer drum, wherein said individual apertures which are disposed in a cross sectional plane of said mixer drum communicate with an annular channel provided on the outer periphery of said mixer drum, and wherein said annular channel is connected to an exhaust gas tube.

6. An apparatus according to claim 4, wherein in at least one of said tube portions, at a location distant from said combustion tube, an exhaust gas valve is provided for varying the aperture cross section.

7. An apparatus according to claim 6 comprising at least one exhaust gas valve disposed in a respective tube portion, wherein each exhaust gas valve is operable by means of a bi-metal element provided within said respective tube portion such that with increasing temperature within said tube portion, said exhaust valve moves into an open position, and with decreasing temperature within said tube portion, said exhaust gas valve moves into a closed position.

* * * * *